United States Patent [19]

Alms et al.

[11] 4,076,492

[45] Feb. 28, 1978

[54] ELECTRONIC DRYER

[75] Inventors: Erhardt E. Alms, Barrington; Donald P. DeVale, Sycamore; William Russell, Genoa, all of Ill.

[73] Assignee: AFE Industries, Inc., Lake Zurich, Ill.

[21] Appl. No.: 754,353

[22] Filed: Dec. 27, 1976

[51] Int. Cl.[2] ..... F27B 9/40; F26B 17/16

[52] U.S. Cl. ..... 432/43; 34/174; 432/44

[58] Field of Search ..... 432/43, 44, 45; 34/174

[56] References Cited

U.S. PATENT DOCUMENTS

| | | | |
|---|---|---|---|
| 3,400,466 | 9/1968 | McClaren | 432/43 |
| 3,451,662 | 6/1969 | Burghard et al. | 432/44 |
| 3,526,969 | 9/1970 | Alms et al. | 34/174 |
| 3,636,638 | 1/1972 | Noyes | 34/174 |

*Primary Examiner*—John J. Camby

*Attorney, Agent, or Firm*—Hill, Gross, Simpson, Van Santen, Steadman, Chiara & Simpson

[57] ABSTRACT

An electronic dryer for grain or other materials which includes a gas burner and one or more blowers for providing heated air into a plenum chamber from which such heated air passes through the material to be dried between two spaced walls formed with openings such that the heated air can pass therethrough for drying the material. Temperature sensing means in the form of an elongated member such as a wire is mounted within the plenum chamber so as to detect the plenum chamber temperature and to control the duty cycle of the burner and second and third temperature sensing means are mounted between the spaced walls adjacent the inlet and outlet areas of the heated air so as to detect and determine the moisture content in the materials to be dried. These sensors are also elongated and detect the temperature at many portions of the dryer so as to more accurately determine the temperature.

15 Claims, 16 Drawing Figures

100
101
102
103
104
106
107
108
109
110
112
113
118
119
121
122
123
124
125
126
162
181
182
184
186
187
188
189
191
192
193
194
196
197
197a
197b
197c
197d
197e
200
401
402
404
409
68

Fig. 2
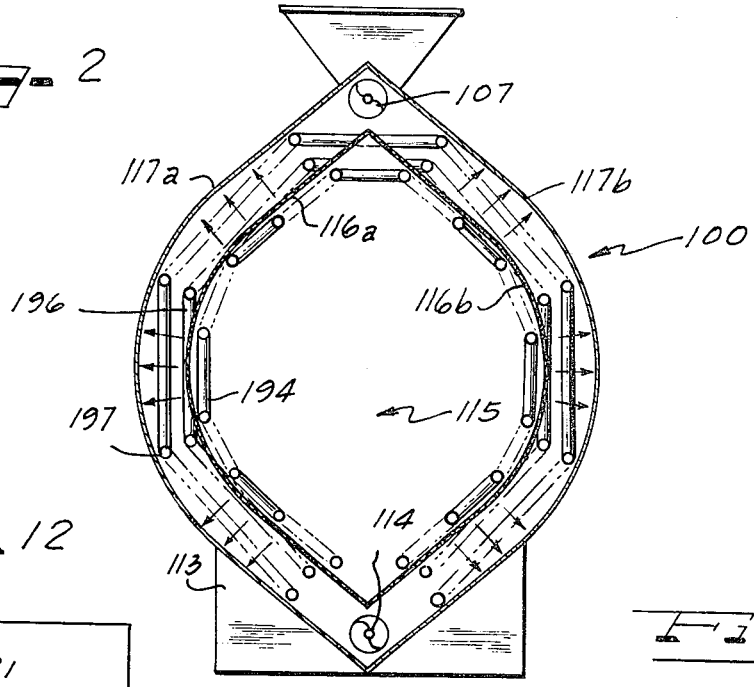
Fig. 12
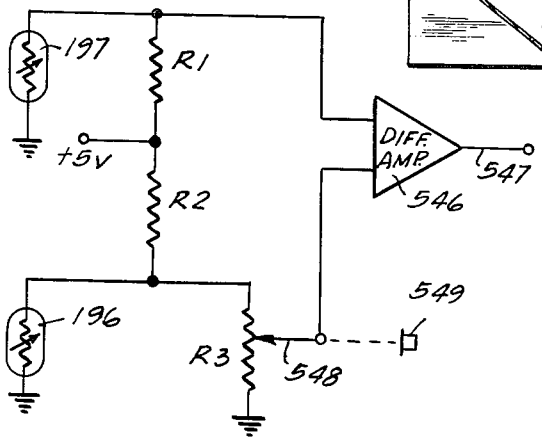
Fig. 13
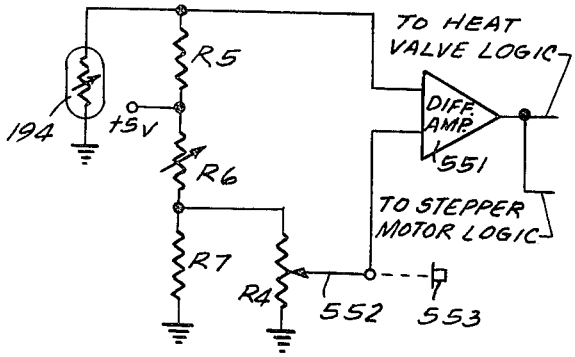
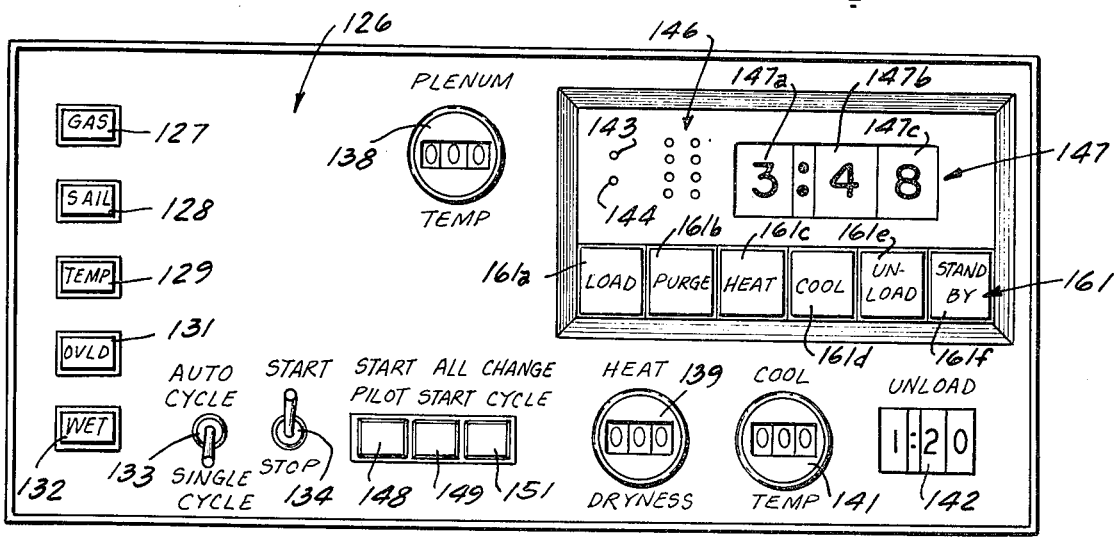
Fig. 3

| | |
|---|---|
| FIG. 4 | FIG. 6 |
| FIG. 5 | FIG. 7 |

HEAT POT
COOL POT
+5
T CONNECTOR
504
COOL DIFF. AMP.
HEAT DIFF. AMP.
281
272
273
194
196
197
59
LIGHT MONITOR FOR MOTOR 146
7400
62
7485 COMP.
7490 0-9 MIN.
54
7485 COMP.
61
266
7451 CONTROL STEPPER MOTOR
7473 HEAT STEPPER MOTOR
265
253
13
7492 0-5 SEC. X10
53
7400
CLOCK CONTROL
7414
GENERAL INVERTER
7440 0-9 SEC
52
7490 DECADE X10
58
7492 COUNTER 1/2 CLOCK
63
10

LOAD PRESSURE SWITCH
68
404
UNLOAD
BURNER LIMIT
PLENUM LIMIT
401
402
WET GRAIN SWITCH
407
MOTOR OVERLOAD
408
128
231
241
SAIL
GAS PRESSURE SWITCH
409
BASO1
BASO2
410
411
BURNER LIMIT RELAY
WET GRAIN RELAY
417
418
PILOT
412
414
416
MOTOR OVERLOAD RELAY
MASTER CONTROL RELAY
413
520
24V RELAY POWER
IGNITION TRANSFER
186
M30
421
422
M26
129
132
131
128
127
A1
A2
A3,6
A18,19
+12V
A10

ELECTRONIC DRYER

BACKGROUND OF THE INVENTION

1. Field of the Invention

This invention relates in general to dryers and in particular to dryers of the type for drying grain or other materials.

2. Description of the Prior Art

Grain dryers are operated in remote areas where there are major fluctuations in the line voltage which cause inaccuracies in the operation of the drying machines. Also, due to the large size blowers and vibration associated with such machines, many electrical transients and noise problems exist which tend to cause inaccurate control and operation of the machines. It has been proposed to use thermistors or other heat sensors to detect temperature in a plenum chamber of a burner as well as within the material to be dried. However, since the air within the plenum chamber is very turbulent due to the violent movement of the air through the blowers into the plenum chamber and through the dryer the temperature sensed at discrete points may not truly indicate the average temperature within the plenum chamber or within the material being dried. Also, the direction of the wind can substantially change the temperature and amount of heated air passing through the material being dried at certain points as, for example, if the wind is from the north it will tend to resist air passing out of the dryer on the north side and will increase the passage of air through the south side of the dryer, thus, causing non-uniform air passage through the material and, thus, erroneous temperature indications can be obtained using discrete temperature point sensors.

SUMMARY OF THE INVENTION

The present invention provides a novel dryer as, for example, for grain or other materials which utilizes elongated temperature sensors as, for example, in the form of stainless steel wire with a first sensor wound back and forth within the plenum chamber adjacent the air exit from the plenum chamber into the drying chamber so as to thus sense an average or composite temperature within the plenum chamber and, further, to include second and third temperature sensing elongated members spaced closely adjacent but offset from the respective side walls of the drying chamber and wound back and forth through the drying chambers such that the composite resistance of the temperature sensors indicates much more accurately the temperature in the grain or material being dried than those of the point source temperature sensors of the prior art.

Another feature of the invention is to provide an electronic control means for a dryer wherein if two or more fan motors are used, stagger starts the motors so as to reduce the instantaneous current drain on the power source, thus, preventing overload and interruption of power by opening circuit breakers.

Another feature of the invention is to provide numerous safety features which assures that dangerous conditions cannot exist in the dryer.

Yet, another feature of the invention is to provide a variable gas feed servo system wherein the amount of gas applied to the burner is calculated and controlled in a positive manner so as to obtain optimum drying and economy.

Another feature of the invention is to provide an electronic control wherein all of the numerous cycles are controlled in an optimum manner in a fashion which provides maximum safety of operation and economy.

Another object of the invention is to control the dryer such that the material being dried is very accurately monitored so that the desired percentage of moisture will be obtained in the dried output material.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 2 is a sectional view of the dryer illustrated in FIG. 1;

FIG. 3 is a detail plan view of the control unit for the dryer;

FIG. 12 is a schematic of the moisture control circuit;

FIG. 13 illustrates the heat cycle control circuit;

DESCRIPTION OF THE PREFERRED EMBODIMENTS

Figures 1, 14, 15:
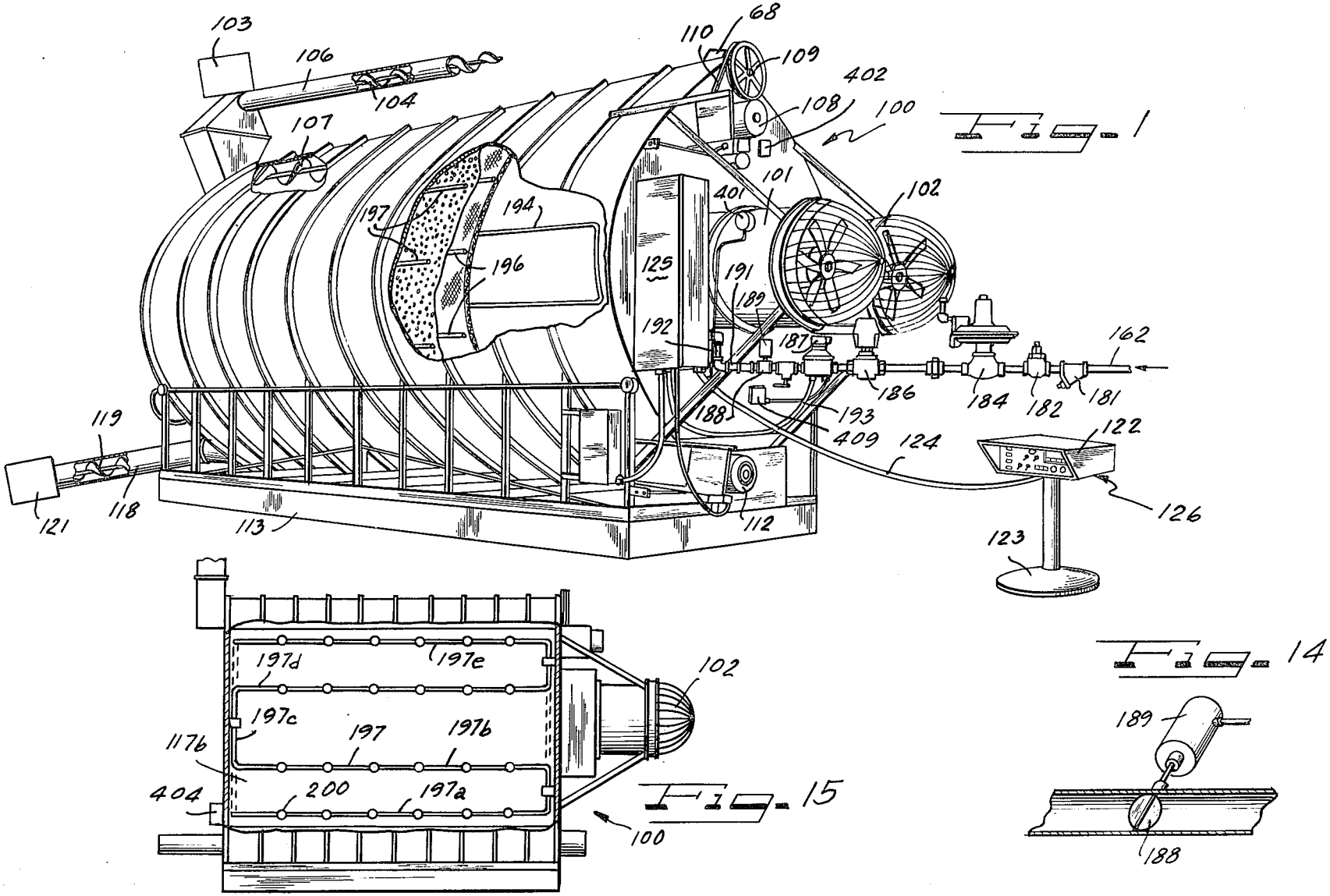
FIG. 1 is a perspective view of a dryer according to the invention.
FIG. 14 illustrates the stepper control motor and valve.
FIG. 15 is a sectional view through the dryer.

The dryer 100 of the invention is mounted on a frame 113 and has a pair of blowers 101 and 102 mounted on one end wall thereof. A plenum chamber 115 is formed within the dryer and perforated side walls **116*a* and 116*b* receive air from the dryer. The drying container is defined by the space between the inner walls 116*a* and 116*b* and outer walls 117*a* and 117*b* as illustrated in FIG. 2. It is to be realized that all of the walls 116*a*, 116*b*, 117*a* and 117*b* are formed with openings through which the air can pass. As shown in FIG. 1, an auxiliary auger motor 103 is connected to an auger 104 which supplies through chute 106 to the top of the dryer material to be dried which is driven by top auger 107 mounted in the top of the dryer. A pulley 109 is connected to the auger 107 and a belt 110 connects the pulley 109 to the top auger drive motor 108. A bottom auger 114 is driven by a botton auger motor 112 and an output auxiliary auger 119 is mounted in chute 118 and is driven by an output auxiliary motor 121**.

A control 122 is mounted on a base 123 and is connected by a cable 124 to a power box 125. The control is shown in greater detail in FIG. 3 and comprise a plurality of indicators switches 127, 128, 129, 131 and 132 mounted on one end of the control. A switch 133 controls either single cycle or auto cycle. A switch 134 is a start stop switch, 148 is a start pilot switch, 149 is an all start switch and 151 is a change cycle switch. A plenum temperature dial control 138 is provided on the control as are dryness dial control 139, a cool dial control 141 and an unload thumb switch 142. Indicator lights 143 and 144 and 146 allow cycling valve monitoring and a clock 147 is provided. Six inputs are provided by the functions 161 and are load-purge, heat, cool, unload, and standby.

The gas supply pipe 162 is supplied through a reducer 181 to a manual on-off valve 182 and then through a pipe to a regulator 184. A safety valve 186 takes 26 seconds to open and ½ second to close and supplies gas to a cycling valve 187 which is open when heat is called for and closed when heat is off. A butterfly valve 188 is controlled by a stepping motor 189 and supplies gas to the burner through the computer valve control and the burner pipe 192. A pilot line 193 supplies gas to the pilot.

Within the plenum chamber 115 is mounted a plenum temperature sensing element 194 which is mounted closely adjacent the walls **116*a* and 116*b* on the inside of the plenum and is supported from such wall by insulating standoff members. The plenum temperature sensing wire 194 is wound longitudinally of the dryer and thus its total resistance is a composite indication of the plenum temperature adjacent the walls 116*a* and 116*b***.

Within the grain drying area between the walls 116 and 117 are mounted second and third temperature sensing elements 196 and 197 which are respectively mounted so that they extend longitudinally of the dryer and are connected at opposite ends so that they circuitously pass respectively along the inner walls **116*a* and 116*b* and the outer walls 117*a* and 117*b*. In other words, the inner wall temperature sensing wire 196 passes longitudinally back and forth along each of the walls 116*a* and 116*b* and the total resistivity of the wire 196 indicates the temperature adjacent the inner walls 116*a* and 116*b*. Likewise, the sensing wire 197 senses the temperature at the output surface of the walls 117*a* and 117*b*. The wires 196 and 197 are supported and insulated from the walls 116 and 117** by suitable insulating standoffs.

The operation of the machine comprises the conventional steps of load, purge, heat, cool, unload and standby.

In a conventional installation, wet grain will be present in a wet grain bin and the dryer will be loaded by first starting the auger motor 108 and then with a delayed start, the auxiliary auger motor 103 to supply wet grain to the dryer. A grain switch senses when the dryer is loaded and filled with grain and turns off the auger motors 103 and 108. Then the blower motors 101 and 102 are started in a stagger fashion such that one motor starts before the other to reduce the overload condition on the power supply. This substantially eliminates opening of circuit breakers caused by such overload.

The burner is then turned on and the gas flow and temperature of the plenum chamber is controlled by the electronic controls of the invention and the plenum sensing plenum sensing wire 194.

After the grain has been dried to the desired temperature as detected by the temperature sensing wires 196 and 197 in a manner which will be described herein, the burners are turned off and the machine enters the cool cycle. Occasionally, during the heat cycle, the grain will shrink which releases pressure from the load pressure switch which actuates a load time delay circuit and after time out stagger starts the load motor 108 and the auxiliary load motor 103 to maintain the dryer filled with grain.

During the cool cycle, the blower motors 101 and 102 continue to run but the burners are off and such cycle continues until terminated by the electronic control in a manner to be described hereafter.

During unload, the auxiliary auger 119 is driven by the auxiliary auger motor 121 and then the unload auger 114 is driven by the motor 112 to unload the dryer. After unload, there is an unload time delay to clear the machine and auxiliary chute 118.

The electronic control starts the machine with a prepurge during which first the blowers come on in a staggered fashion and run for 15 seconds before the safety valve 186 is opened. The ignition transformer is energized to light the pilot light and the heat thermocouple produces voltage which energizes the baso valve. The baso activates the ready light. By depressing the all start button, the machine enters the load cycle and the machine is loaded until the grain actuates the load pressure switch which indicates that the dryer is full of grain. Then the purge cycle is initiated and the blowers are turned on in a staggered fashion so as to assure that any accidental accumulation of gas is removed from the dryer. Then the heat cycle is initiated. Initially, the blowers are on from the previous purge cycle and then the burners are turned on and are governed by the thermostat wire which measures the total resistance of the wire 194 which is supplied to an operational amplifier where it is compared with a reference resistance set by the temperature control 138 so as to pulse the burner on and off. A digital stepping motor controls the butterfly valve 188 so as regulate the amount of gas that is supplied to the burner during the burn cycle.

The use of the temperature sensing wire 194 which passes repeatedly longitudinally of the dryer on both sides of the plenum chamber compensates for turbulent flow, small pressure differentials and for various voltage variations in the power supply which drives the blower motors.

The gas valve control is in response to changes and ambient temperature, changes in plenum temperature and changes in gas pressure.

The dryness of the grain is detected by noting the temperature differential as measured by the resistivity of the wires 196 and 197. Initially, when the dryer is turned on, the temperature adjacent the walls 116 and 117 will be the same since it is that of the ambient air without the burner being turned on. However, as soon as the burner is turned on and heat is applied, the temperature adjacent the inside wall 116 will be much hotter than the temperature adjacent the external wall 117 and this differential indicates the percentage dryness of the grain. Thus, when the burner is initially turned on, the temperature and resistivities of wires 196 and 197 will initially be the same but very rapidly the temperature on the wire 196 will become higher. Then as the dryer operates for a longer and longer period of time, the temperature and resistivities of the wires 196 and 197 will gradually become closer and closer together and this differential is indicative of the moisture content of the grain. Thus, an operational amplifier receives input voltages from two sources, one being from a bridge circuit containing the wire 196 and the other containing the wire 197 so as to obtain an output signal when the temperature and resistivity of wire 197 has approached the temperature and resistivity of wire 196 to the preset desired amount which determines the moisture content of the grain. The input circuit to such operational amplifier includes a potentiometer for setting the desired moisture content of the grain.

After the grain has reached the desired moisture content, the machine switches into the cool cycle which time the blowers continue to operate. After the cooling cycle, the unload cycle is initiated and the machine then goes into a standby mode.

The plenum temperature wire 194 controls the burner on, controls the gas flow and detects the medium temperature in the plenum chamber. The inside grain wire 196 functions during the heat cycle and the differential temperature as measured by the temperature between the inside wire 196 and the outside grain wire 197 controls the heat cycle until the grain has the desired percent moisture, or in the cool cycle determines the turn off point.

Figures 4, 4A:
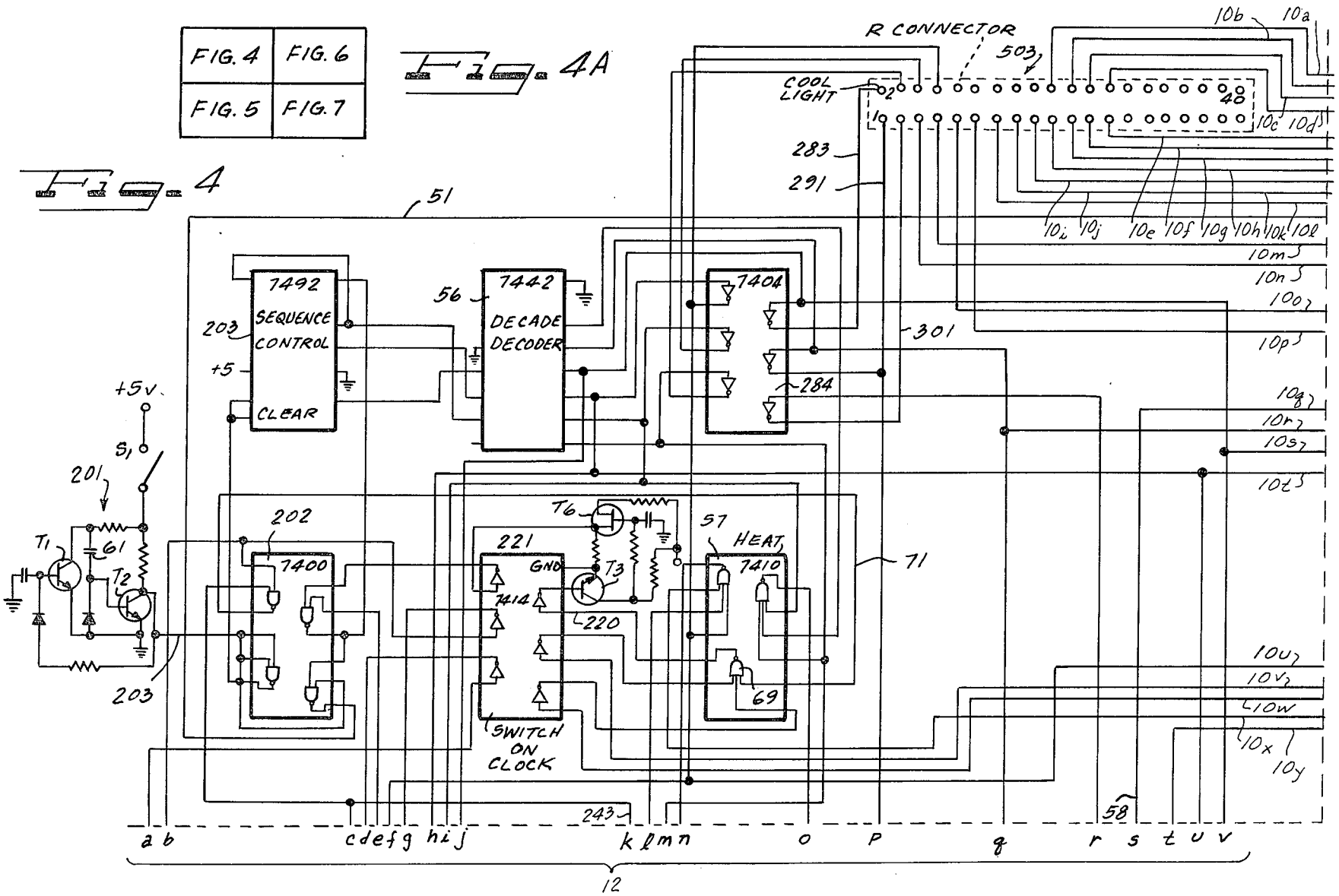
FIG. 4A is a schematic view illustrating the arrangements of FIGS. 4 through 7.
FIGS. 4 through 7 are schematic diagrams of the invention.

FIGS. 4 through 7 comprise an electrical schematic of the electronic control of the invention which is constructed of TTL logic circuits and these Figures fit together as illustrated by FIG. 4A. Power is supplied to the electronic control by closing switch S1 which energizes transistor T2 which prevents transistor T1 from turning on. All of the memories are cleared and all digital counters and clocks are set to zero as soon as power turns on. Current to the base of transistor T2 prevents T1 from turning on and current is supplied to the base of transistor T2 as long as the capacitor C1 is not charged. When capacitor C1 is charged and blocks further current, the output of transistor T2 collector goes up and turns on transistor T1. Transistor T1 clamps the capacitor C1 which prevents further current from energizing transistor T2. The circuit will be stable in this condition until voltages falls below the threshold of turn-on at the base of transistor T1 to allow the sequence to repeat. The addition of the transistor T1 allows the sequence to repeat to turn power on and off repeatedly. The circuit is also reasonably insensitive to glitches and power and will not reset unless there is a clear power off. The collector of transistor T2 is connected to the integrated circuit 202 which may be a type 7400 Motorola integrated circuit and a low condition on input lead 203 produces a high voltage condition on lead 51 at an output of the circuit 202 which will clear clock circuits 52, 53 and 54 to zero. Integrated circuit 203 which is a type 7492 sequence controller supplies an output to type 7442 decade decoder 56 which changes the binary input to decade output. Circuit 57 comprises a type 7410 and includes three input NAND gates. Integrated circuit 206 has an output lead 58 which is connected to the thumb wheel switchboard 59.

Comparators 61 and 62 are type 7485 and receive inputs and compare the number returning from the thumb wheel switchboard 59 with the output of the clock comprising the circuits 52, 53 and 54. The clock must time out before initiating sequencing. 63, the first counter in the clock chain, is cleared and the clock will not count during load cycle and the comparator cannot and will not initiate switching into additional modes under this condition.

Figure 11:
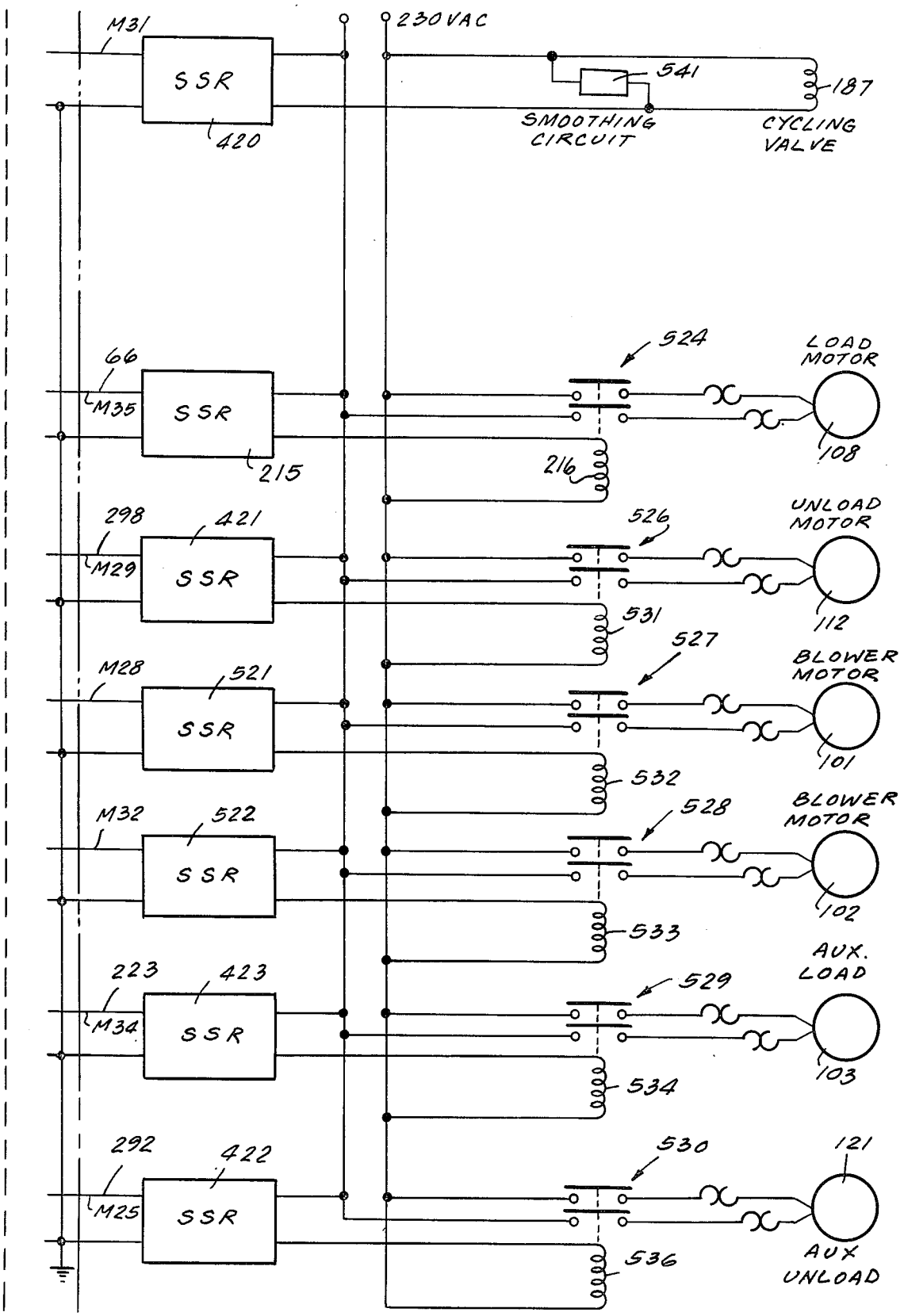
FIG. 11 illustrates the power circuit.

Integrated circuit 64 initiates operation of the load motor and can be a type 7451 integrated circuit. This is the load motor 108 which drives the top auger 107 on the machine when the voltage on lead 66 is high. FIG. 11 illustrates lead 66 which supplies an input to energize a switching relay 215 which energizes a relay 216 to close contacts to the load motor 108 to the 230 volt power terminals.

The load pressure switch 68 senses grain in the top of the dryer and is closed when the grain does not extend to the top of the dryer and is open when the dryer is full.

The circuit 57 initiates switching and includes a three input NAND gate 69 which supplies an output through lead 220 through a diode in integrated circuit 221 to the base of transistor T3. A high signal on the base of transistor T3 restricts switching of the uni-junction oscillator transistor T6 and the signal from the NAND gate 69 is high to inhibit the oscillator uni-junction T6 to inhibit the clock during loading.

The instant power calls for loading the load timer 72 produces a high output on lead 222 then the load motor 108 is energized. The auxiliary load motor 103 is inhibited by a time delay determined by the time delay circuit 73 after which power is applied to the auxiliary load motor 103 by lead 223 as illustrated in FIG. 11. The motors 108 and 103 continue to operate until the pressure switch 68 opens which means that the dryer is full of grain.

The invention also includes a number of safety circuits. Even though a command for load signal exists on lead 83 from the stop clock circuit 87, the safety circuits prevent operation unless transistors T4 and T5 are conducting. The main safety relay is opened unless all of the interlocks indicate that safe conditions exist. When start of the machine occurs and the initiate pilot button 148 is energized, the blower motors will start on a stagger basis and the latching circuit and timer circuits 74, 76 and 77 will initiate start, pre-purge, gas-on and check for baso operation. When the signal on lead 84 at the output of latch circuit 77 goes low and the output on lead 86 goes high, all circuits are ungrounded which will allow the stop clock 87 to count, and actuate the system.

The load and auxiliary motors 103 and 108 stop simultaneously after the load cycle has been accomplished.

During the purge cycle, if the blowers 101 and 102 are not on, the gas valves will not turn on to supply gas to the burner. For safety, sail switches 138 and 231 illustrated in FIG. 10 must also be closed and these switches comprise vanes mounted in the output path of the blowers so as to detect when they are running and when they are running the switch 231 illustrated in FIG. 10 will be closed. The sail switches are connected to lead 241 which supplies an input to the double latch chain cycle and contact bounce eliminator circuit 242 and supplies an output on lead 243 to the circuit 57 to inhibit the heat valve when the sail switches are not closed. In the purge cycle, there are no voltages applied to the stop clock circuit 87 and the clock immediately starts counting. When ten seconds pass, sequencing is initiated through transistor T6 and the dryer will pass into the heat cycle.

During the heat cycle, the blower motors must be running. The heat valve cannot be actuated unless the machine is in the heat cycle. When the heat valve turns on, it has been enabled by three constraints, (1) the machine being in the heat cycle, (2) the blower motors actuated, and (3) the output of differential amplifier 252 which receives the input from lead 194 must be sensing a temperature below the present burner turn-off temperature.

When heat is not required, the sensor voltage on wire 194 will be higher than the heat set potentiometer 247 and the output of the differential amplifier 252 will be low.

The temperature sensing element 194 is connected to leads 250 and 251 and supplies inputs to the differential amplifier 252 which produces an output on lead 253 which is high when heat is required. Lead 261 is connected to circuit 206 which receives an input for heat valve cycling from circuit 57.

When heat is called for, the heat stepper motor 189 and the circuits 265 and 266 which controls the angular position of the stepper motor as well as the direction it operates, are actuated when lead 253 goes high which indicates heat is required. The load pressure switch 68 is also connected through a resistor to the base of transistor T7 which actuates the load motors 103 and 108 when shrinkage of the grain calls for additional load in the dryer.

When the ratio of the voltage on the outside wire 197 and inside wire 196 reach the correct ratio as determined by the desired moisture content of the grain, the output of heat differential amplifier 272 on lead 273 will become high and supply this input to the out of heat circuit 271 to terminate the heat cycle. When this occurs, the clock counts for two minutes and then switches the machine out of the heat cycle. The heat valve is closed and when the clock times out the sequence control 203 is actuated to the next cycle which is the cool cycle.

During the cool cycle, the clock, the clock counts and the blowers operate until the temperature as detected by wires 196 and 197 indicates the grain temperature has reached a stabilization temperature. Then the clock stops counting until wires 196 and 197 indicate that the grain temperature has reached to approximately ambient air temperature. The clock then resumes counting until 4 minutes is reached. T6 then initiates sequencing.

The stabilization timer 282 during initiation of the heat cycle prevents the device from initially going into the cool cycle because the sensing wires 196 and 197 will read the same temperature at the instance the dryer goes into the heat cycle. Thus, the stabilization timer 282 prevents this for 12 minutes which could be preset to other times as 4, 6, or 8 minutes. During the cool cycle, a voltage is applied to lead 283 from integrated circuit 284 to energize the cool light in the indicator panel 161 illustrated in FIG. 3.

After the cool cycle has been completed, the blower motors 101 and 102 are turned off. The lead 291 is connected to the unload light which is energized on the indicator 161 illustrated in FIG. 3 and the auxiliary unload motor is energized by lead 292 and after a time delay the unload motor 112 is energized by lead 298. When the grain is unloaded, an unload pressure switch 404 controls the stop clock circuit which turns off motors 112 and 121 and energizes the sequence controller 203 such that the machine goes into the "standby" condition.

Standby inhibits the clock. The auto/stop switch inhibits the clock in the stop position when the control is in the standby cycle. The standby light lead 301 is connected to the standby light and is turned on by circuit 284 in the standby condition and the lead 302 is connected to the auto/stop switch which inhibits the clock in the stop position when the control is in the standby cycle. It is to be noted that the lead 303 goes to the stop clock 87.

The chain switch 408 monitors overload of the motor and represents all of these switches connected in series. This switch is connected to lead 306 and is connected to the stop clock.

The sail switches 128 and 231 (one for each blower) detect when the blowers are on or off and if a blower is off the heat valve cannot open. Also, when the device is in heat condition it stops the clock. If a sail switch sticks, the heat valve would be off. If blades fall off of the blower, even though the blowers 101 and 102 are actuated, the sail switches would not be energized and, thus, the heat cycle could not be initiated.

FIG. 15 is a sectional view through the dryer illustrating the outer wire 197. It is to be noted that the wire is wound longitudinally through the grain chamber and is supported from the wall **117*b* by standoffs 200. The wire extends longitudinally adjacent the lower portion of the dryer and then extends upwardly and makes a longitudinal passage through the machine indicated by 197*b* and passes upwardly as indicated by 197*c* and then passes back through the chamber as indicated by 197*d*, 197*e* and so forth until the wire 197 substantially detects the average temperature present over the surface of the walls 117*b* and 117*a***.

The inner sensing wire 196 is wound in the same fashion closely adjacent the inner walls **116*a* and 116*b* to detect the average temperature in the grain chamber adjacent the walls 116*a* and 116*b***.

The plenum temperature wire 194 is also wound in a similar manner to wire 197, but is spaced within the plenum chamber 115 closely adjacent to the inside of walls **116*a* and 116*b*** outside of the grain chamber.

As shown in FIG. 1, a gas pressure switch 409 detects gas pressure. A burner limit switch 401 is mounted to the dryer as shown in FIG. 1. A plenum limit switch 402 is also mounted to the dryer. An unload pressure switch 404 is mounted to the dryer as illustrated in FIG. 15.

Figure 5:
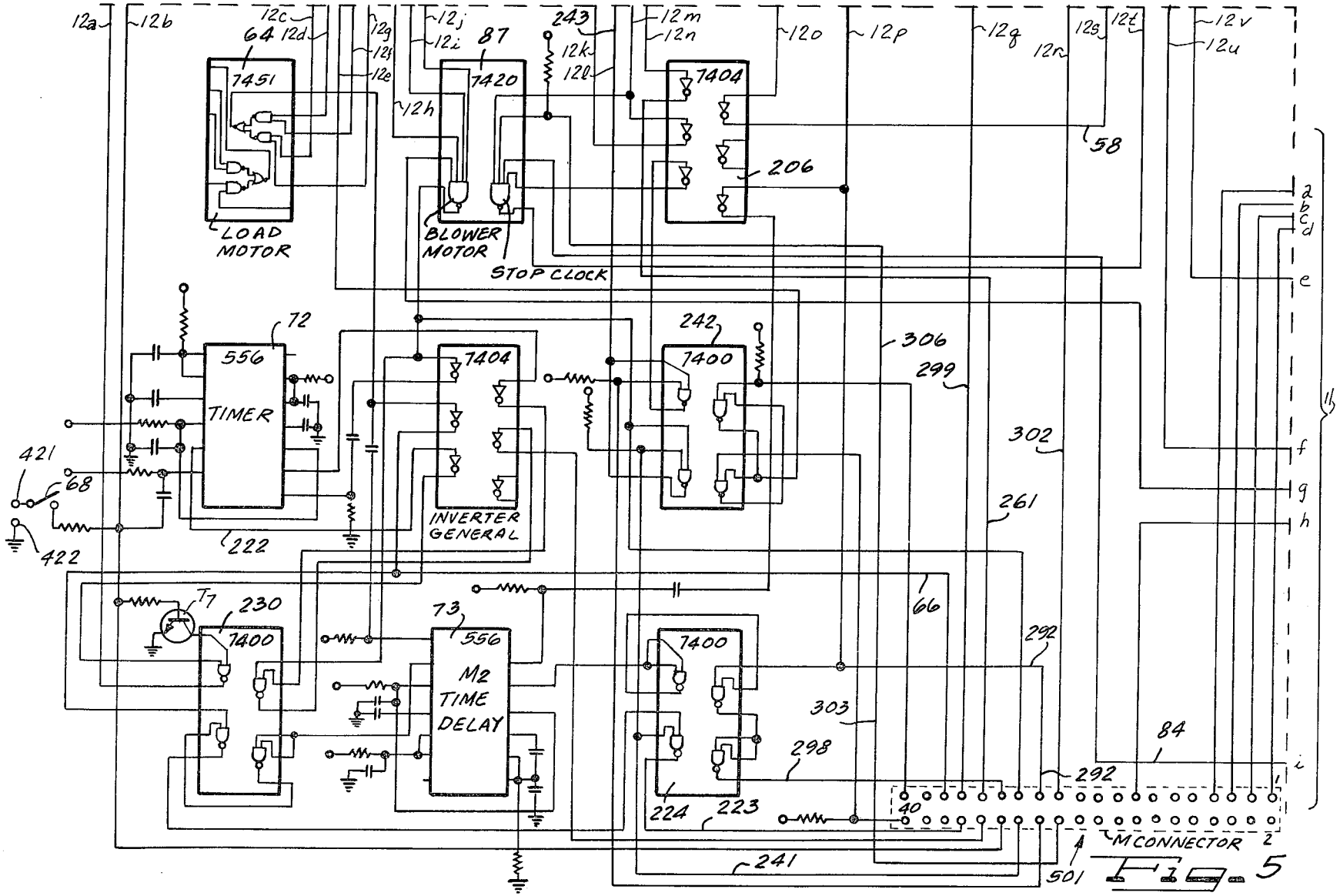
Figure 6:
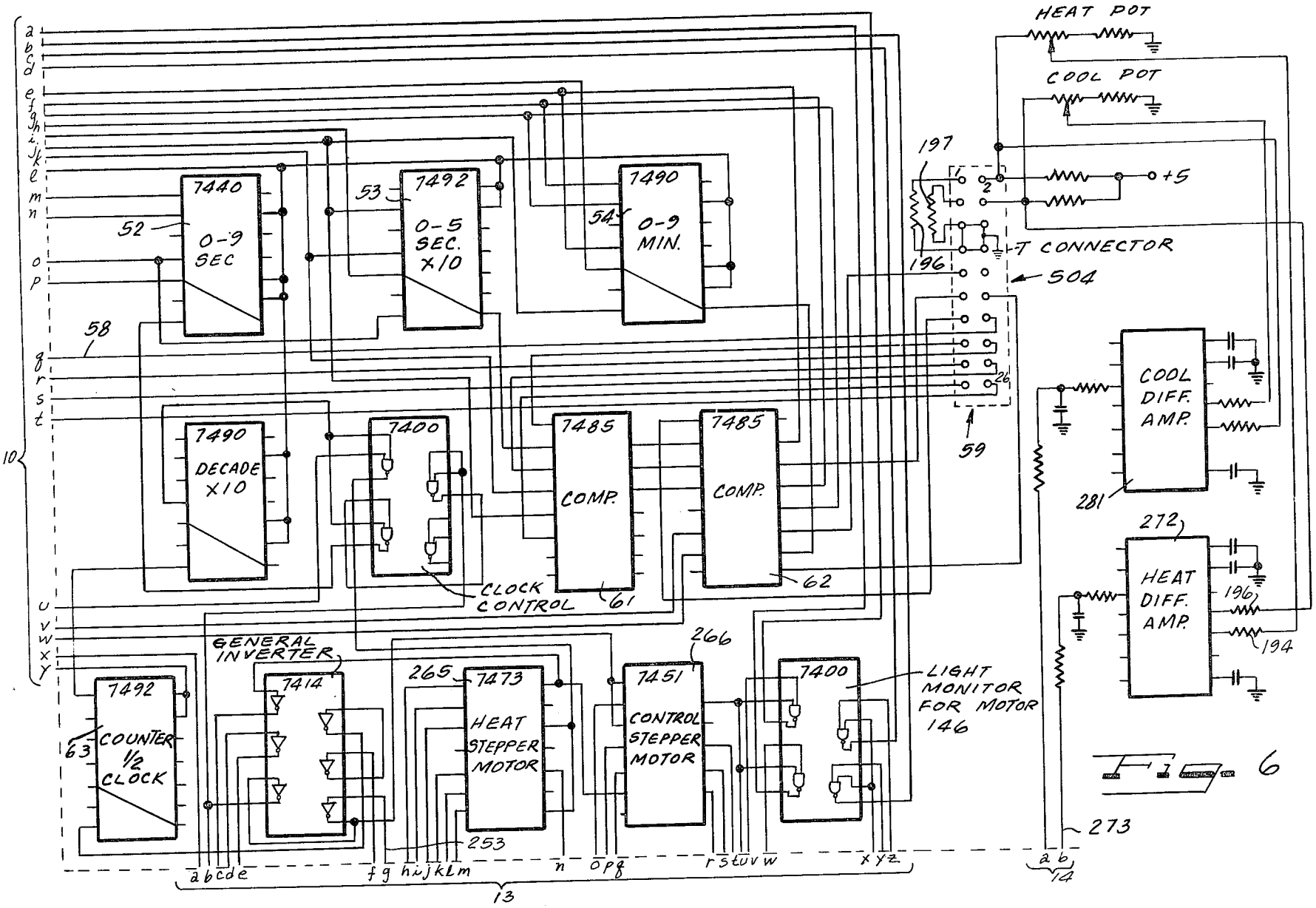
Figure 7:
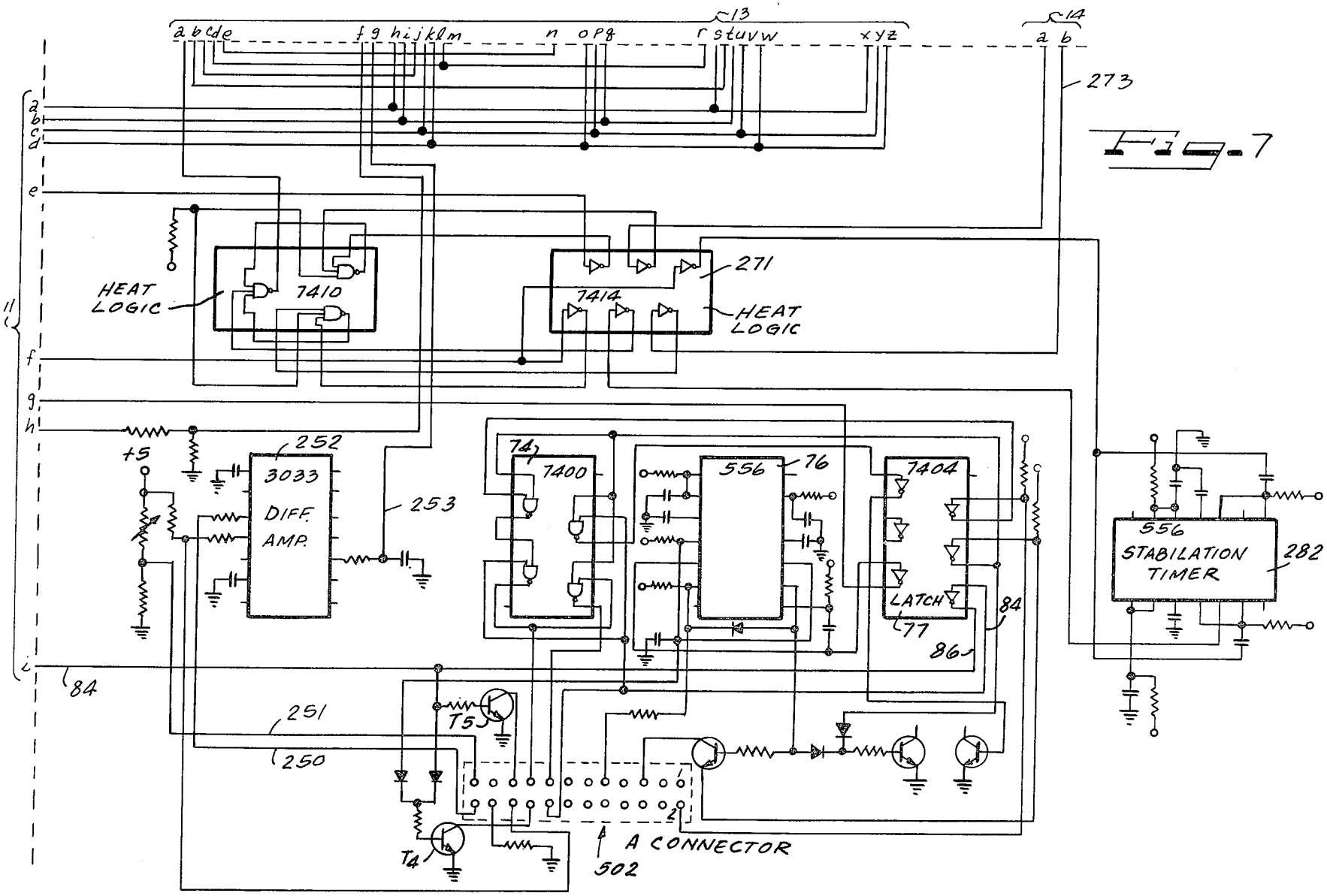

FIG. 5 illustrated the M connector 501 and the following legend illustrates the connection of the contacts of this connector.

| | | | | | |
|---|---|---|---|---|---|
| 1 | Stepper Motor Drive Output | | 2 | Stepper Pulse Output | |
| 3 | Stepper Motor Drive Output | | 4 | | |
| 5 | Stepper Motor Drive Output | | 6 | | |
| 7 | Stepper Motor Drive Output | | 8 | GND | |
| 9 | GND | 10 | GND | | |
| 11 | +12 volts of AMP | P1 | 12 | 12 Volts-OP Amp | P2 |
| 13 | GND | P3 | 14 | GND | P4 |
| 15 | GND | P5 | 16 | GND | P6 |
| 17 | P.S. Clock input | P7 | 18 | +12 for lights | P8 |
| 19 | +5 | P9 | 20 | +5 | P10 |
| 21 | +5 | P11 | 22 | +5 | P12 |
| 23 | Cycle Complete Sw | Auto-SS | 24 | Cycle Complete Sw | Auto-S |
| 25 | Unload M2-SSR | I-13 | 26 | Onload P.S. Input | I-14 |
| 27 | Blower MTRSS Relay | M1 I-15 | 28 | Sail Sw input | I-16 |
| 29 | Unload Motor M1 | I-17 | 30 | Load P.S. | I-18 |
| 31 | Heat Valve SSR | I-19 | 32 | Blower Motor SSR Mz | I-20 |
| 33 | Unload Pressure Switch Output | I-21 | 34 | Load Motor SSR Mz | I-22 |
| 35 | Load Motor ss Relay | | 36 | Aux Heat Valve SSR | I-24 |

-continued

| M1 | | I-23 | |
|---|---|---|---|
| 37 | | 38 | Change cycle Sw |
| 39 | GND - Change Cycle Sw | 40 | Change cycle Sw |

The A connector 502 is connected as indicated with the following:

| | | | |
|---|---|---|---|
| 1 | Baso N/C | 2 | Baso N.O. |
| 3 | Baso GND | 4 | All Start |
| 5 | All Start GND | 6 | Baso GND |
| 7 | Pilot Start Light | 8 | All Start Light |
| 9 | | 10 | Pilot Relay |
| 11 | Pilot Start | 12 | Pilot Start |
| 13 | Stop Run (Pilot) | 14 | Stop Run - Pilot |
| 15 | | 16 | Run Stop Sw All |
| 17 | Run Stop Sw. All | 18 | MCR |
| 19 | MCR | 20 | All Relay SSR GND |
| 21 | Blower SSR GND | 22 | Heat Sensor Wire |
| 23 | GND for Heat Sensor Wire | 24 | To Temp Pot Pin 2(Y) |
| 25 | To Temp Pot Pin 1 (G) | 26 | From Temp Pot Pin 3 (e) |

The R connector 503 terminals are connected as follows:

| | | | |
|---|---|---|---|
| 1 | Unload light | 2 | Cool light |
| 3 | Cycle complete light | 4 | Load light |
| 5 | Sec. B | 6 | Purge light |
| 7 | Sec. C | 8 | Heat light |
| 9 | Sec. D | 10 | +5 v |
| 11 | Sec. A | 12 | +5 v |
| 13 | Sec. 10B | 14 | Ground |
| 15 | Sec. 10C | 16 | Ground |
| 17 | Sec. 10A | 18 | +12 v for lights |
| 19 | Min B | 20 | Heat light Stepper |
| 21 | Min C | 22 | Heat light Stepper |
| 23 | Min D | 24 | Heat light Stepper |
| 25 | Min A | 26 | Heat light Stepper |

The T connector 504 is connected as follows:

| | | | |
|---|---|---|---|
| 1 | Inner heat sensor wire | 2 | Inner heat sensor wire |
| 3 | Outer heat sensor wire | 4 | Outer heat sensor wire |
| 5 | Ground (op Amps) | 6 | Ground (op Amps) |
| 7 | Ground (op Amps) | 8 | Ground |
| 9 | Min B | 10 | |
| 11 | Min C | 12 | Min A |
| 13 | Min D | 14 | Sec × 10 Input |
| 15 | Sec × 10A | 16 | Unload Sw Input |
| 17 | Sec 10B | 18 | Cool Sw Input |
| 19 | Sec 10C | 20 | Heat Sw. Input |
| 21 | GND | 22 | GND |
| 23 | GND | 24 | +5 Volts |
| 25 | +5 Volts | 26 | +5 Volts |

Figure 10:
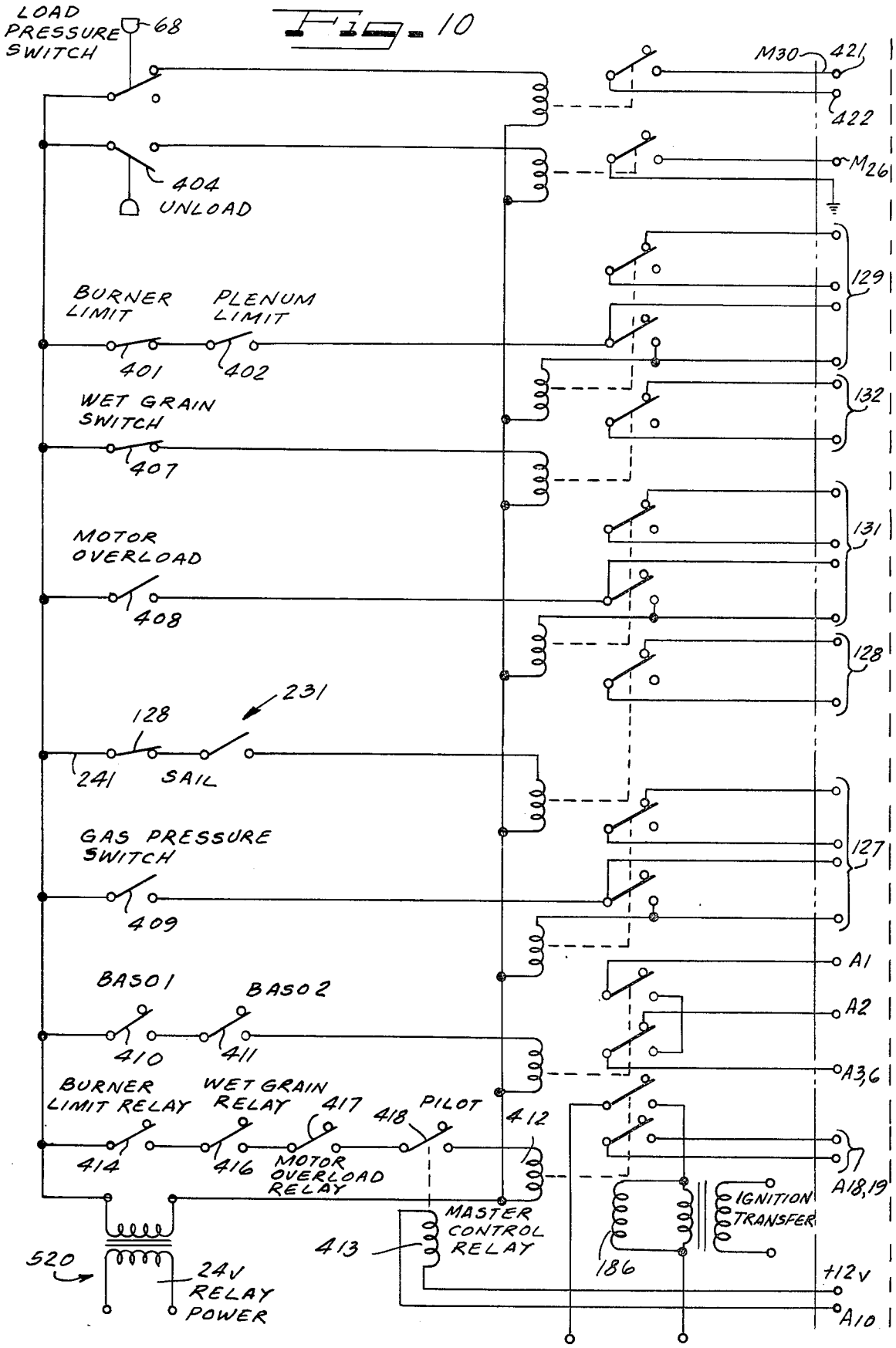
FIG. 10 illustrates the switching circuit.

FIG. 10 illustrates the load pressure switch 68 which is connected to control a relay that connects contacts 421 and 422. Unload pressure switch 404 controls a relay that moves a switch to connect terminal M26 to ground. Burner limit switch 401 and plenum limit switch 402 are connected in series and control indicator 129. Wet grain switch 407 controls a relay that is connected to indicator 132. Motor overload chain switch 408 which may comprise a plurality of motor overload switches in series controls a relay that drives indicator 131. Sail switches 128 and 131, one for each motor, controls a relay that controls sail indicator 128. Gas pressure switch 409 is connected to gas indicator 127. A pair of thermocouples 410 and 411 detect the presence of the pilot light and are connected in series and control a relay which control switches connected to terminals A1, A2, A3, 6 and A18, 19. A pilot relay 413 controls the pilot switch 418 and has one terminal connected to A10 and the other to plus 12 volts. The motor overload relay 117 switch is in series with the switch 418. The wet grain switch 416 is in series with the switch 418 and the burner limit relay 414 is in series with the switch 416. The master control relay is in series with the switches 414, 416, 417, 418 of the secondary of a power relay 520.

FIG. 11 illustrates the controls for the load and unload motors, the blower motors and the cycling valve 187. 230 Volt AC is applied to relay contacts 524, 526, 527, 528, 529 and 530. The relay contacts are controlled by relays 216, 531 through 536, respectively. Control relays 215, 421, 521, 522, 423 and 422 respectively energize the relays 216 and 531 through 536. Input to these relays are supplied from M terminals 35, 29, 27, 32, 34 and 25. The cycling valve 127 is in parallel with a smoothing circuit and a relay 420 is controlled by M terminal 31. The smoothing circuit 541 smoothes power.

Figure 8:
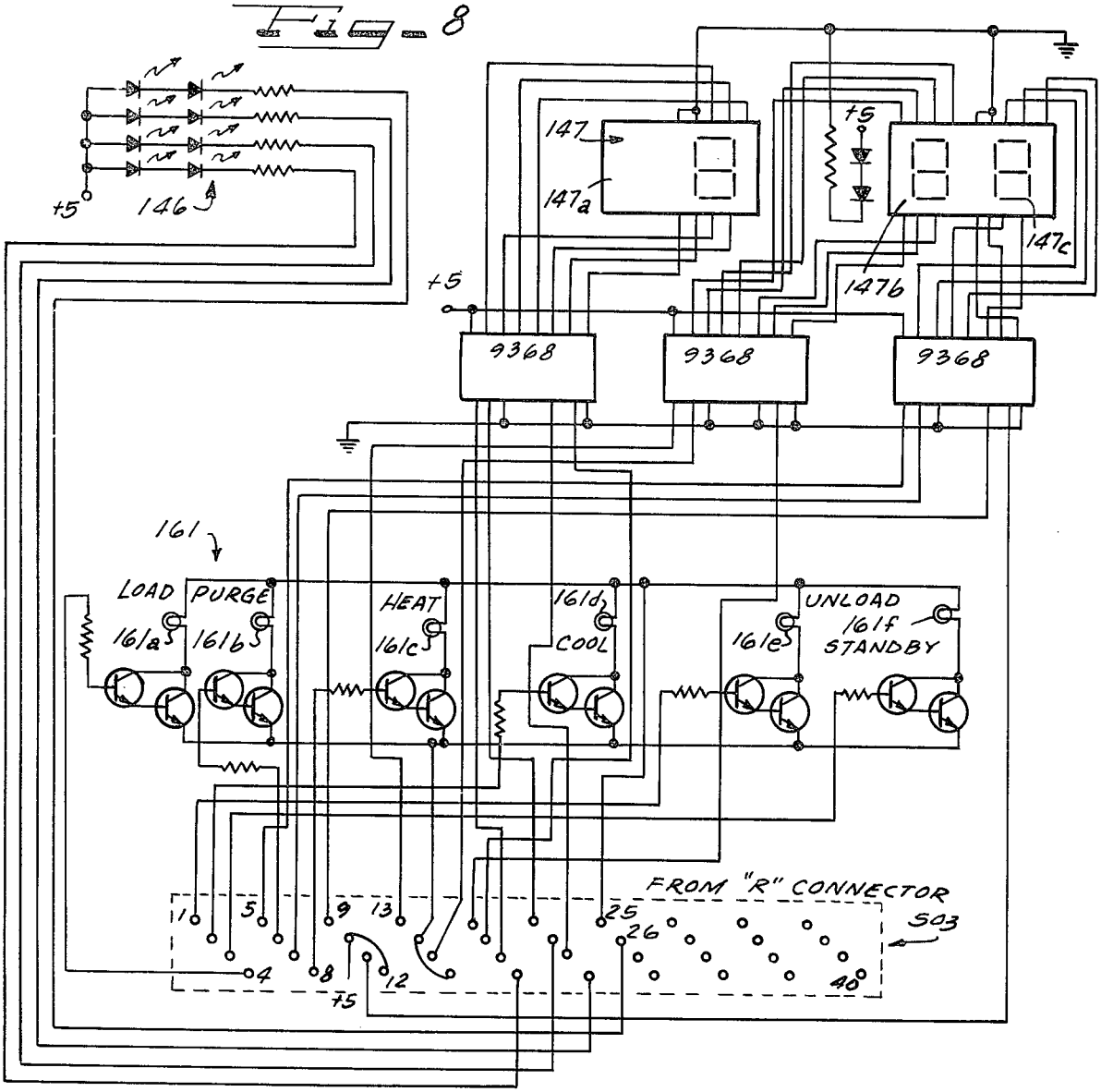
FIG. 8 is a schematic diagram of the indicator light control panel.

FIG. 8 illustrates the control panel for the indicator lights, the lights 161 as well as the lights 146. This circuit receives inputs from the R connector 503 as indicated.

Figure 9:
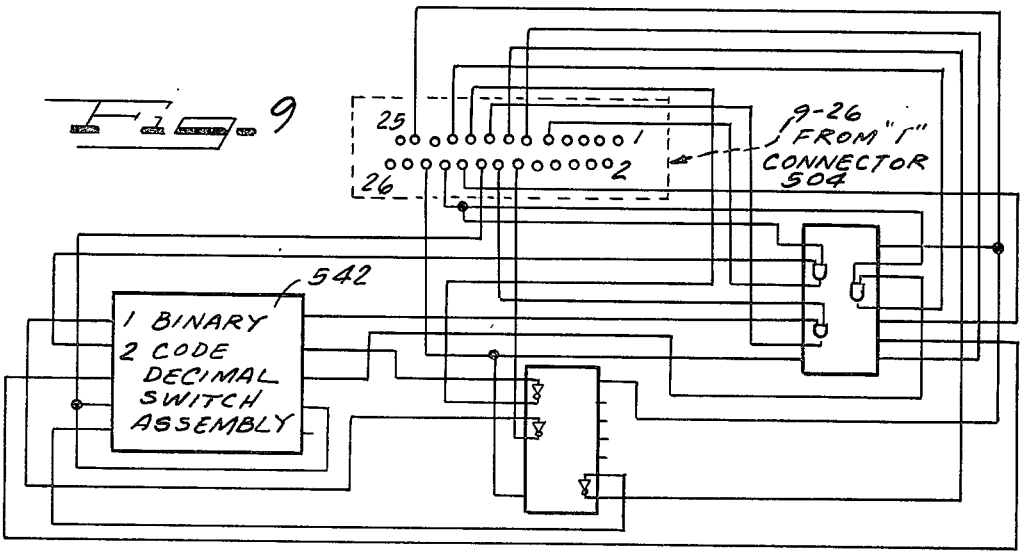
FIG. 9 is an electrical schematic of the switch thumb wheel circuit.

FIG. 9 illustrates the thumb wheel switch circuit including the binary code decimal switch assembly 542 and this circuit receives inputs from terminals 9—26 from the T connector 504.

FIG. 12 illustrates the inner temperature sensor 196 and the outer temperature sensor 197 connected to the differential amplifier 546 which supplies an output to terminate the heat cycle on terminal 547. A pair of precision resistors R1 and R2 are connected across the sensors 196 and 197 and their junction point is connected to a suitable voltage as for example plus 5 volts. A precision (R3) potentiometer is connected in parallel with sensor 196 to ground and a wiper contact 548 can be adjusted by knob 549 to set a desired moisture content for the gain being dried. The wiper contact 548 is connected to differential amplifier 546.

FIG. 13 is a simplified version of the heat valve logic and the stepper motor control logic. The plenum sensor wire 194 supplies an input to a differential amplifier 551 which receives a second input from a temperature potentiometer R4 that has a variable contact 552 controllable by knob 553 for setting the maximum temperature within the plenum chamber. This would conventionally vary from a temperature of 110° F for seed corn to 500° F for field corn. One end of the potentiometer R4 is connected to ground and the other end is connected to the junction point between a variable resistor R6 and the resistor R7. The other side of resistor R7 is connected to ground. A resistor R5 is connected from Resistor R6 to the wire 194 and a suitable voltage source as, for example, plus 5 volts is applied between resistors R5 and R6.

FIG. 14 illustrates the stepper motor 189 and the butterfly valve 188 which controls the amount of gas applied to the burners.

The stepper motor receives 1 second pulses from the clock and moves in one or the other direction each second. The direction the stepper motor moves is governed by the thermostat differential amplifier 252. When additional heat is desired the stepper motor 189 steps in a direction to open valve 188, thus, increasing fuel. When the heat is off the stepper motor 189 steps in a direction to close butterfly valve 188 and the stepping motor operates between open and closed limits.

The repetition rate of the cycle is a function of the setting of the differential amplifier oscillator and in a particular embodiment 4 cycles per minute were established and a 50% duty cycle was utilized. The gearing between the stepper motor 189 and the butterfly valve 188 was chosen so that the butterfly valve changed about 1/6 of a degree for eact step of the stepping motor.

The stepping motor and butterfly valve automatically adjust the gas flow to the demanded temperature as, for example, if not enough gas if being supplied, the stepping motor will be pulsed on say for 9 pulses but will be pulsed closed for only 7 pulses resulting in an average more open position for the butterfly valve and thus greater heat. This system thus operates as a closing servo system which automatically compensates for ambient temperature, wind, gas pressure and other fluctuations.

The following chart illustrates the voltage on the inner wire 196 and the outer wire 197 in a particular run of grain during the heat and cool cycle.

| | 196 Wire Inner | 197 Wire Outer | Cycling Temperature Range in Plenum | | |
|---|---|---|---|---|---|
| 1 | .4437 | .4438 | | | |
| 2 | .4591 | .4452 | 190–205, | 188–200 | |
| 3 | .4664 | .4479 | 186–210, | 184–202 | |
| 4 | .4685 | .4481 | 185–212, | 187–217 | |
| 5 | .4696 | .4484 | 188–215, | 190–210 | |
| 6 | .4705 | .4488 | 189–207, | 189–203, | 189–209 |
| 7 | .4712 | .4496 | 190–211, | 189–204, | 187–205 |
| 8 | .4715 | .4503 | 190–210, | 186–208, | 186–198 |
| 9 | .4717 | .4520 | 188–205, | 189–201, | 186–200 |
| 10 | .4721 | .4534 | 183–216, | 188–208, | 187–220 |
| 11 | .4724 | .4547 | 188–203, | 187–205, | 187–205 |
| 12 | .4718 | .4559 | 187–208, | 185–198, | 186–197 |
| 13 | .4721 | .4571 | 185–208, | 186–213, | 187–187 |
| 14 | .4729 | .4580 | 186–204, | 187–206, | 184–197 |
| 15 | .4724 | .4591 | 184–199, | 184–196, | 184–200 |
| 16 | .4726 | .4603 | 187–197, | 184–194, | 181–200 |
| 17 | .4724 | .4613 | 185–200, | 185–198, | 185–198 |
| 18 | .4726 | .4620 | 185–200, | 183–199, | 183–196 |
| 19 | .4727 | .4628 | 184–201, | 185–196, | 185–200 |
| | Switch into Cool | | | | |
| 20 | .4678 | .4631 | | | |
| 21 | .4513 | .4636 | | | |
| 22 | .4442 | .4639 | | | |
| 23 | .4438 | .4607 | | | |
| 24 | .4438 | .4533 | | | |
| | Switch into Unload | | | | |

It is to be noted that initially the temperature on the inner and outer wires was about the same as shown by the first reading. Very rapidly as indicated by the second reading very shortly the temperature on the inner wire became much greater than that on the outer wire and gradually the temperature on the outer wire into approach that on the inner wire and this differential is a function of the moisture content of the grain. In other words, by establishing the differential temperature between the outer and inner wires the moisture content can be very accurately controlled. As reading 19 the desired moisture content was obtained and the machine was switched into the coal cycle. At reading 24, the machine was switched into unload cycle. The readings 1 through 19 separated were taken at 5 minute intervals.

In a particular model according to this invention, the plenum temperature sensing element 194 was stainless steel wire of 0.093 inch diameter. The sensing elements 196 and 197 were stainless steel wire of 0.120 inch diameter.

It is seen that this invention provides a new and novel dryer and although it has been described with respect to preferred embodiments it is not to be so limited as changes and modifications may be made therein which are within the full intended scope as defined by the appended claims.

We claim as our invention:

1. A dryer comprising a plenum chamber, a burner mounted in said plenum chamber to supply heated air thereto, a drying chamber mounted adjacent to said plenum chamber and formed with foraminous inner and outer sidewalls through which heated air from said plenum chamber passes, a first temperature sensing means mounted within said drying chamber adjacent said inner side wall, a second temperature sensing means mounted within said drying chamber adjacent said outer side wall, a third temperature sensing means mounted within said plenum chamber and connected to said burner to control it, and a first differential amplifier connected to said first and second temperature sensing means and producing a first output when the temperature difference between said first and second temperature sensing means exceeds a predetermined amount and producing a second output when said temperature difference between said first and second temperature means does not exceed said predetermined amount and said differential amplifier connected to said burner to prevent it from turning on when said differential amplifier produces said second output.

2. A dryer according to claim 1 wherein a time delay is connected between said differential amplifier and said burner such that when said burner initially turns on said differential amplifier cannot turn off said burner for a predetermined time.

3. A dryer according to claim 2 including a first potentiometer connected between at least one of said first and second temperature sensing means and having an adjustable wiper contact connected to said differential amplifier for setting said predetermined amount.

4. A dryer according to claim 3 including a second differential amplifier connected to control said burner and receiving the output of said third temperature sensing means, a reference voltage source supplying a second input to said second differential amplifier, and means for varying said reference voltage source.

5. A dryer according to claim 4 including a variable fuel control valve for said burner connected to said second differential amplifier and the output of said second differential amplifier controlling the on-off cycling of said burner and the amount of fuel supplied to said burner.

6. A dryer according to claim 5 wherein variable fuel control valve comprises a stepper motor and a variable position valve in the fuel line controlled by said stepper motor and when said differential amplifier calls for heat said stepper motor progressively opens said variable position valve and when said differential amplifier does not call for heat said stepper motor progressively closes said variable position valve such that the average position of said valve is determined by the on and off duty cycle of said burner.

7. A dryer according to claim 1 wherein said first temperature sensing means comprises an elongated metallic member which is insulatingly mounted to said inner sidewall and is wound so as to sense the average temperature adjacent said inner sidewall over a substantial portion of said inner side wall.

8. A dryer according to claim 1 wherein said second temperature sensing means comprises an elongated metallic member which is insulatingly mounted to said outer side wall and is wound so as to sense the average temperature adjacent said outer side wall over a substantial portion of said outer side wall.

9. A dryer according to claim 1 wherein said third temperature sensing means comprises an elongated metallic member which is insulatingly mounted from said inner wall within said plenum chamber and is wound so as to sense the average temperature in said plenum chamber adjacent a substantial portion of said inner wide wall.

10. A dryer according to claim 1 wherein said first, second and third temperature sensing means comprise metallic wires insulatingly mounted to said inner and outer side walls over substantial portions of said side walls so as to respectively, sense the average temperatures adjacent said inner side wall in said drying chamber, the average temperature adjacent said outer side wall within said drying chamber, and the average plenum chamber temperature adjacent said inner side wall.

11. A dryer according to claim 1 including a pair of blower motors attached to said dryer to impel air into said plenum chamber.

12. A dryer according to claim 11 including blower motor starting means connected to said blower motors to stagger start them to reduce the surge current in the power supply.

13. A dryer according to claim 11 including an electronic control means, material loading and unloading means with said electric control means connected to said first, second, and third temperature sensing means and to said burner, said blower motors and said material loading and unloading means to load material into said dryer, dry said material to a desired dryness, cool said material, and unload said material from said dryer.

14. A dryer according to claim 13 including a dryer empty sensing means connected to said electronic control means.

15. A dryer according to claim 13 including a dryer full sensing means connected to said electronic control means.

* * * * *